United States Patent [19]

Kicherer et al.

[11] Patent Number: 4,940,886

[45] Date of Patent: Jul. 10, 1990

[54] ELECTRIC HOTPLATE

[75] Inventors: Robert Kicherer; Felix Schreder, both of Oberderdingen, Fed. Rep. of Germany

[73] Assignee: E.G.O. Elektro-Gerate Blanc u. Fischer, Fed. Rep. of Germany

[21] Appl. No.: 329,960

[22] Filed: Mar. 29, 1989

[30] Foreign Application Priority Data

Apr. 20, 1988 [DE] Fed. Rep. of Germany ... 8805230[U]

[51] Int. Cl.[5] ..... H05B 3/70

[52] U.S. Cl. ..... 219/457; 219/458; 219/467

[58] Field of Search ..... 219/457, 458, 459, 460, 219/464, 465, 467, 449

[56] References Cited

U.S. PATENT DOCUMENTS

| | | | |
|---|---|---|---|
| 1,534,823 | 4/1925 | Ziola | 219/467 |
| 2,422,057 | 6/1947 | Weinhardt | 219/467 |
| 4,135,081 | 1/1979 | Fischer | 219/449 |
| 4,467,181 | 8/1984 | Fischer | 219/458 |

FOREIGN PATENT DOCUMENTS

| | | | |
|---|---|---|---|
| 2500586 | 7/1976 | Fed. Rep. of Germany | 219/464 |

*Primary Examiner*—Teresa J. Walberg

*Attorney, Agent, or Firm*—Eckert Seamans Cherin & Mellott

[57] ABSTRACT

In an electric hotplate (1) a hotplate body (2) is constructed in such a way that a holding element (25) provided to fix the hotplate in a hob and arranged below the hotplate can be located in a relatively small distance from the top-side respective the cooking surface (3) of the hotplate body (2). Thereby a very flat mounting arrangement is possible. For example an outer flange rim (6) of the hotplate body (2) can have a groove-like reception depression (30) for an engagement of the holding element (25), this engagement also serving a rotation prevention. It is also possible to construct the outer flange rim extremely low, e.g. in such a way that its lower edge face is located higher than the lower edge face of a central stud of the hotplate body.

21 Claims, 4 Drawing Sheets

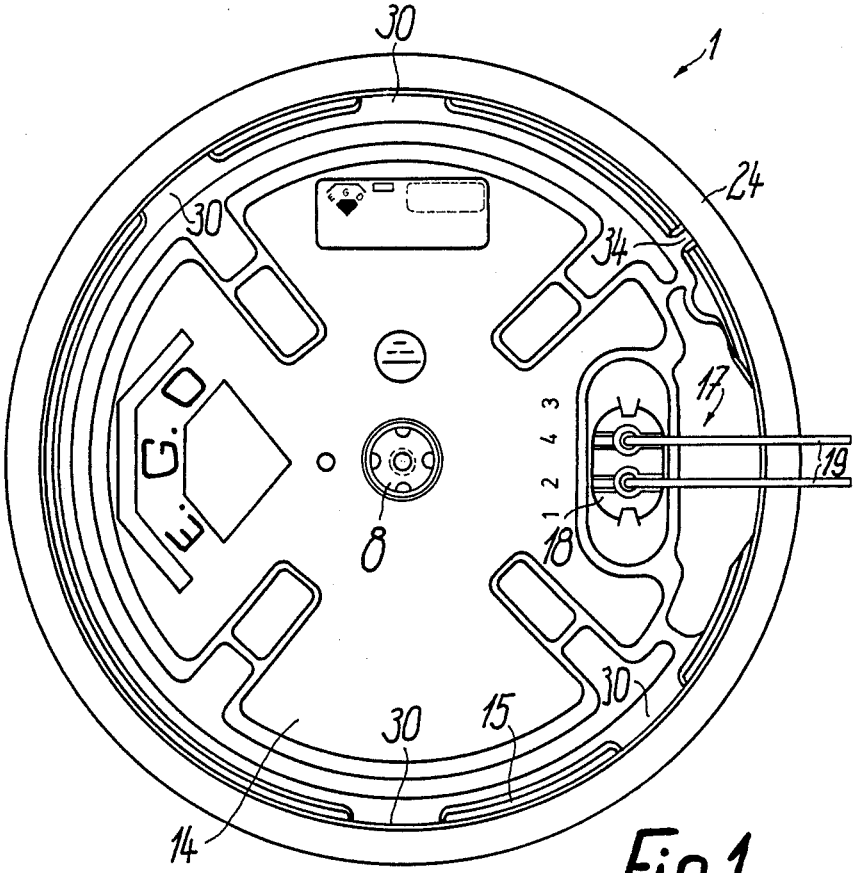
Fig.1
Fig.2
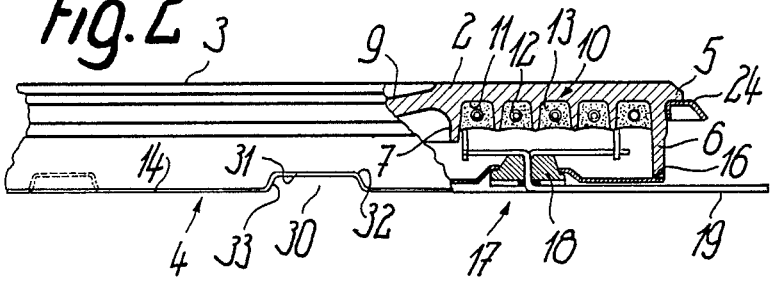

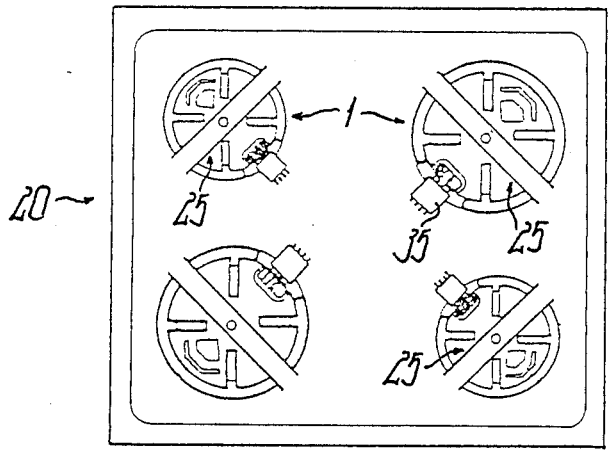
Fig. 5
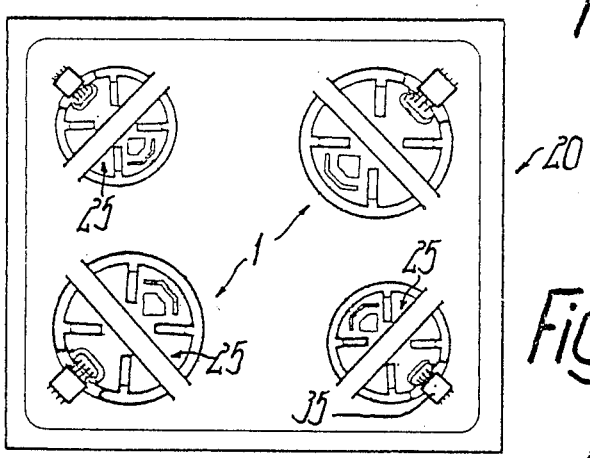
Fig. 6
Fig. 7
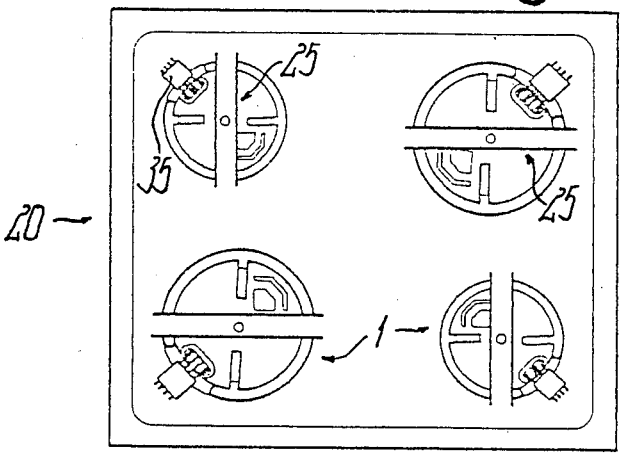

ELECTRIC HOTPLATE

DESCRIPTION

The invention relates to an electric hotplate with a hotplate body. The latter generally directly forms on its side remote from the underside a cooking surface and is appropriately given a varying height in the vicinity of the underside. It can be provided with at least one engagement member, which cooperates with a holding or retaining element, by means of which the hotplate is secured with respect to the cooker plate in such a way that the hotplate is tensioned downwards or against an upwardly directed contact face of the cooker plate.

In the case of cooker hobs, as well as cookers in whose casing, e.g. below the cooking points is provided a baking oven muffle, there is a need for a very flat construction of the cooking point arrangement, so as to lose the minimum amount of space beneath the same. In the case of known constructions the holding element is positioned relatively deeply below the undersides of the electric hotplates and to this extent more constructional height is required at the underside of the cooker plate than would be necessary as a result of the engagement height of the electric hotplates.

The problem of the invention is to provide an electric hotplate of the aforementioned type making it possible in simple manner to reduce its overall fitting height.

According to the invention this problem is solved in the case of an electric hotplate of the aforementioned type in that the hotplate body is made flatter or shallower in thermally protected manner, e.g. has in its radially outer region a reduced overall height. On the underside there is appropriately at least one reception depression for the flush reception of at least part of the holding or retaining element. Thus, at least in individual zones of the hotplate body or over the entire extension of a holding element, the latter can be higher than hitherto, e.g. arranged in such a way that it does not merely project roughly by its thickness over the underside of the hotplate body, but instead its underside extends at the most up to or above the lowest level of the hotplate or hotplate body. It is conceivable to so adapt to one another the hotplate and holding element that the latter at no point projects beyond the underside of the hotplate, or only projects over said hotplate underside by its sheet metal thickness.

In the case of many hotplates, the underside of the hotplate body is profiled in various ways, namely with downwardly directed projections. For example, the hotplate body can have an outer flange edge close to its outer circumference and an inner flange edge close to the recessed zone in the cooking surface. Between the two flange edges is bounded an annular, less far downwardly projecting heating zone, which e.g. has at least one spiral groove with at least one heating resistor embedded in an insulating material on the underside of the hotplate body. The inner flange edge generally projects less far downwards than the outer flange edge, which with its end face can define the lowest level of the underside of the hotplate body. Particularly in the case of hotplate bodies with completely closed top or cooking surface, it is also possible for a center stud to project on the underside and is appropriately located in the center axis of the hotplate and is surrounded in radially spaced manner by the inner flange edge or the heating zone. Admittedly said center stud can project downwards as far as the outer flange edge, but it is particularly appropriate if the lower end face of the center stud is higher than the lower end face of the outer flange edge or the lowest level of the remaining hotplate body by at least the thickness of the holding element or the depth of the reception depression. Of said projections made in one piece with the hotplate body from cast material, appropriately those against whose underside engages the holding element are upwardly displaced at least in the vicinity of said holding element to such an extent that said recessed reception of the holding element is possible. However, it can also be advantageous if the lower end face of the outer flange edge is higher than that of the center stud.

A particularly advantageous further development, more especially of an electric hotplate of the indicated type, comprises providing at least one reception depression for the holding element for preventing the hotplate from turning with respect to the cooker plate. Preferably the lateral edges of the reception depression are directly associated with the outermost lateral edges of the holding element as rotational turning preventing stops, so that there is no need to shape any separate turning preventing member from the holding element or its central portion located on the underside of the hotplate. The complete turning preventing member or its part engaging in the underside of the electric hotplate is in fact at the same level as the central portion of the holding element, so that no additional overall height is required for the turning preventing member.

The holding element can be admittedly cup or dish-shaped for one or more hotplates, star or cross-shaped, or the like, but a particularly simple construction is obtained if the holding element is constructed in strip-like manner with a substantially constant strip width and the width of the reception depression is adapted to the holding element width, because then a particularly simple alignment of the hotplate with respect to the holding element is possible, as well as a good underventilation of the hotplate. The width of the holding element can be substantially the same as the external diameter of the center stud or slightly larger than the latter.

In order to particularly adequately secure the hotplate and to ensure that the holding element can also be arranged in a completely countersunk manner if it diametrically crosses the underside of the hotplate, at least two facing reception depressions are provided in the outer flange edge of the hotplate body. These reception depressions can have an equal size or can be so constructed that the hotplate can be equally well fitted in two positions turned by 180° with respect to one another.

In the case of hotplates of the aforementioned type the underside of the hotplate body is appropriately closed with a sheet metal or similar cover plate, which appropriately projects beyond said hotplate body underside by at the most its material thickness and engages with a ring edge on the lowest level of the hotplate body, i.e. on the lower end face of the outer flange edge. Thus, the underside of the hotplate is formed by the underside of the cover plate and said underside is lower than the underside of the hotplate body roughly by the material thickness of the cover plate and at least in the stacked state no further parts project beyond the underside of the hotplate. According to the invention this cover plate can be constructed for the countersunk or surface-flush reception of the holding element. Appropriately on its underside, the cover plate has an e.g.

diagonal or radial groove-like reception depression adapted to the outer contour of the holding element. For fixing the cover plate to the hotplate body with respect to the center stud it can e.g. be provided with claw members or can be secured with a screw engaging in a taphole of the center stud. If said screw is constructed as a hollow screw, it can receive a retaining screw passing through the holding element, with which the hotplate can be downwardly tensioned against the holding element.

The reception depression or depressions in the hotplate body are also suitable for preventing the turning of the cover plate with respect to the hotplate body in the predetermined assembly position, as alignment aids or marks for a robot during the assembly of the electric hotplate and/or for contributing to preventing the turning of the complete hotplate with respect to the cooker plate. To this end the cover plate is appropriately provided on the edge for the particular reception depression of the hotplate body with a shoulder, which engages in the associated reception depression of the hotplate body. Said upwardly projecting shoulder forms on the underside of the hotplate or the actual cover plate a reception depression, e.g. for the engagement of the holding element. This can be achieved in simple manner in that the shoulder is constructed in the manner of a lining of the cut-out in the outer flange edge of the hotplate body forming the inner face of the reception depression, so that the effective depression is narrower by twice the material thickness and less deep by the material thickness than the reception depression in the hotplate body.

The base part of the diagonal groove-like or similar reception depression of the cover plate can be directly braced against the center stud of the hotplate body and can e.g. engage on its lower end face.

In order that a connecting piece for the electrical connection of the hotplate provided on the underside of the latter and usually held with an insulator on the cover plate is readily accessible, the reception depression is appropriately circumferentially displaced with respect to said connecting piece. A displacement angle of approximately 45° or an integral multiple of this angle has proved advantageous. Thus, when the hotplate is fitted, in a view of the underside of the latter, the connecting piece is laterally spaced alongside one end of the holding element.

BRIEF DESCRIPTION OF THE DRAWINGS

The foregoing features and further features of preferred developments of the invention can be gathered from the claims, description and drawings and the individual features can be realized alone or in the form of subcombinations in an embodiment of the invention and in other fields, as well as for patentable constructions for which protection is hereby claimed. Embodiments of the invention are described hereinafter relative to the drawings, wherein are shown:

FIG. 1: an inventive electric hotplate in a view from below.

FIG. 2: a detail of the hotplate of FIG. 1 in a part sectional view.

FIGS. 5 to 7: other embodiments of cooker plates in views corresponding to FIG. 4.

DETAILED DESCRIPTION OF THE PREFERRED EMBODIMENTS

Figure 4:
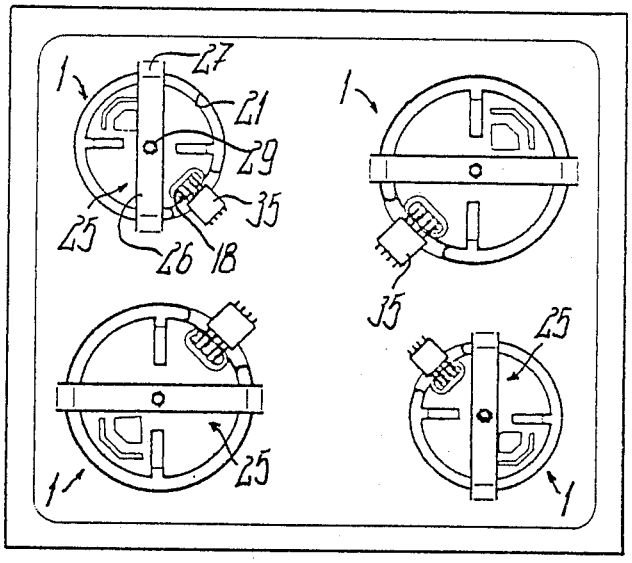
FIG. 4: a cooker plate provided with several hotplates in a view from below.

As shown in FIGS. 1 to 4, an inventive electric hotplate 1 has a hotplate body 2 substantially in one piece and made from cast material, whose annular top forms a substantially through, planar cooking surface 3. On the underside 4 remote from the cooking surface 3, hotplate body 2 has an annular, through, outer flange edge 6 substantially concentric to its center axis and which in the vicinity of the cooking surface 3 on the outer circumference is substantially only overlapped by a collar 5. Concentrically within the outer flange edge 6 is provided an inner flange edge 7 also projecting from the underside of the hotplate body 2, but which projects much less far downwards than the outer flange edge 6. In the center or center axis the hotplate body 2 has a downwardly projecting center stud 8, which optionally tapers conically at an acute angle downwards and which can be provided with a blind taphole emanating from its lower end face. In the center of the annular cooking surface 3, the hotplate body 2 forms a flat depression 9, whose outer circumference is located in the vicinity of the inner flange edge 7 or within its inner circumference.

On the hotplate body 2 is provided an annular heating zone 10 displaced towards the cooking surface 3 with respect to the end face of the outer flange edge 6 and which is bounded by flange edges 6, 7 on the inner and outer circumference. For forming the heating zone 10, on the underside of the hotplate body are provided one or more spiral grooves 11 located concentrically within one another and separated from one another by spiral webs. Within each spiral groove 11 can be arranged a separate, elongated heating resistor 12, e.g. in the form of a resistance wire coil. There may only be a single heating resistor or, according to FIG. 3, three separately switchable heating resistors 12. In the associated spiral groove 11, each heating resistor 12 is embedded in contact-free manner with respect to the hotplate body 2 in an extruded insulating material 13.

The underside 4 of hotplate body 2 is closed by a cover plate 14 profiled several times in the circumferential and radial directions and consequently reinforced, which e.g. has circumferential fins connected to the inner circumference of the outer flange edge 6 and four radial fins reciprocally displaced by 90° and which on the outer circumference form a through, ring disk-like ring edge 15 passing in substantially closed manner over said circumference and which is located on the lower end face 16 of the outer flange edge 6. This ring edge 15 is profiled in substantially the same way as the end face 16, or in complementary manner to the latter in such a way that it engages in rotation-prevented manner and only in a predetermined rotation position in a substantially tightly terminating manner in said end face 16. In the case of a hotplate with center stud 8, the cover plate 14 is appropriately secured with respect to said center stud. If the hotplate body has no center stud, as is the case with so-called automatic hotplates, then it can have a circular construction and can be fixed to the end face of the inner flange edge 7 with suitable fastening members, e.g. fastening screws. The hotplate body of such automatic hotplates has in the center an opening passing through it for the reception of a temperature sensor in place of the center stud.

To the cover plate 14 is fixed a connecting piece 17 with an insulator 18, which is located in the area between the two flange edges 6, 7 and engages in a depression on the underside of cover plate 14 in such a way that at the most it extends up to the lowest level of said underside of the cover plate 14. The same applies, at least in the stacked position, for freely projecting connecting ends 19, or which are combined in a connection coupling, for the electrical connection of the hotplate, said connection ends 19 e.g. being formed by the free ends of leads, which pass through the insulator 18 and in the area within the hotplate body 2 are connected to pin projections of the heating resistor 12, said pin projections projecting downwards out of the insulating material 13. At least in the stacked position, all parts of the leads are at the most as deep or higher than the lowest level of the hotplate or cover plate 14, so that inventive hotplates can be transported and stored without difficulty in stable, compact stacks.

The inventive electric hotplate 1 is intended for an individual or groupwise installation on a profiled cooker plate 20 made from sheet metal or the like, which then has a number of e.g. two, three, four or more cooking points corresponding to the number of fitted hotplates. For each hotplate the cooker plate 20 has a reception opening 21 which is slightly larger than the outer circumference of the associated outer flange edge 6 and optionally slightly smaller than the outer circumference of collar 5. The reception opening 21 is provided in the vicinity of an annular sill 22 shaped in projecting manner upwards from the outer adjacent cooker plate level and surround the hotplate and on whose ring disk-like top the hotplate 1 is supported with a bearing ring 24. The sheet metal, cross-sectionally approximately U-shaped bearing ring 24 is fixed adjacent to the collar 5 by its inner ring side or leg to the outer circumference of the outer flange edge 6, with its ring disk transverse webs is supported on the underside of collar 5 and with its radially outer ring side or leg conically widened downwards in acute-angled manner outside the outer circumference of collar 5 is supported on the top of the sill 22. The opening edge 23 of the reception opening 21 is slightly higher substantially over its entire circumference than the top of sill 22, which correspondingly passes in upwardly circularly stepped manner into said opening edge 23, so that the steps and the reception opening are completely covered by the radially outer ring side of the bearing ring 24. Therefore the opening edge 23 is located below the collar 5 or roughly in the center between the collar 5 and the top of sill 22.

Figure 3:
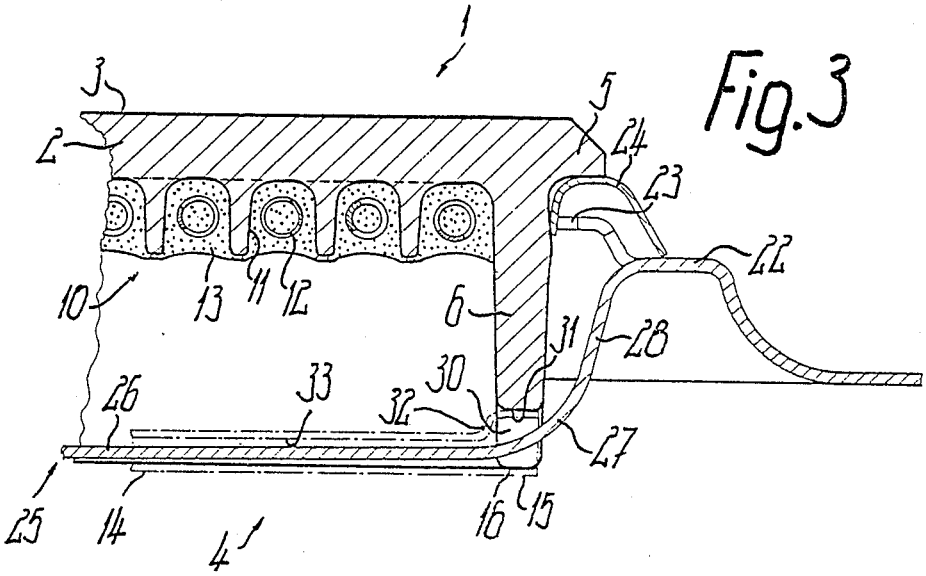
FIG. 3: a further detail of the hotplate in cross-section and a significantly enlarged representation.

For securing purposes the electric hotplate 1 is braced with the lower ring edge of the radially outer ring side of the bearing ring 24 against the top of the cooker plate 20 or the top of rim 22. For this purpose a strip-like holding element 25 having a constant width over its length is provided and connected by one or both ends to the opening edge 23 or the top of the sill 22 and preferably shaped in one piece from the cooker plate 20. The holding element 25 has a flat strip-like, substantially through planar or cross-sectionally linear central portion 26, which is located on the underside 4 of hotplate 1, but is slightly higher than the lowest level of said underside, namely according to FIG. 3 is located e.g. slightly above the lower end face 16 of the outer flange edge 6. At its two ends the central portion 26 passes via a pitch circular, upwardly curved portion 27 into an upwardly and outwardly sloping portion leg 28, which is in turn connected by means of an oppositely curved transition portion to the cooker plate or the top portion of sill 22. The curved portion 27 is at least partly located in the vicinity of the outer flange edge 6. In the center or in the case of automatic hotplates in the vicinity of the inner flange edge 7, the central portion 26 of holding element 25 has at least one through bore for a holding screw 29, which in the represented embodiment is screwed into the taphole of the center stud 8. In the described manner, said holding screw 29 braces the electric hotplate 1 against the top of cooker plate 20.

In order that the electric hotplate 1 can receive in the described manner the holding element 25 on its underside 4, it is provided on the underside with circumferentially distributed reception depressions 30 for the surface-flush engagement of the holding element 25, particularly the central portion 26 and the curved portions 27. In the represented embodiment in the vicinity of the lower end face of the outer flange edge 6, there are at least two diametrically facing reception depressions 30, or which are located symmetrically to a common axial plane of the hotplate body 2, both of which are identical and advantageously constructed in the manner of flat rectangular grooves in such a way that they are slightly downwardly widened. A pair of these reception depressions 30 is appropriately substantially located in an axial plane of the hotplate body 2, which is at right angles to the axial plane passing through the center of the connecting piece 17. Instead of this or in addition thereto, there can also be a pair of reception depressions 30 under an angle, preferably of approximately 45°, to said axial plane in the connecting piece 17. In the axial plane of the latter pair of reception depressions 30 are appropriately also provided two radial fins, while the axial plane of the first-mentioned pair of reception depressions 30 is provided in the center between the two axial planes of the four radial fins. The connecting piece 17 is located between two adjacent radial fins.

For the formation of the particular reception depression 30, the outer flange edge 6 is provided in its lower end face 16 with a cut-out 31 substantially corresponding to the shape of the depression and in which the cover plate 14 engages with a shoulder 32 at least shaped out of its ring edge 15. Said shoulder is so adapted to the shape of cut-out 31, that it engages in substantially clearance-free manner both with its base part on the base of cut-out 31 and with its edges on the lateral faces of cut-out 31. If the cover plate 14 is not raised by at least the approximate depth of the reception depression 30 within its ring edge 15, i.e. between facing reception depressions 30 or in its central field, then it is appropriately provided on its underside with a diametral or diagonal groove 33 uninterruptedly connecting the two facing depressions 30 and whose cross-sections are appropriately the same as those of the depressions 30, so that the latter essentially form the ends of the diagonal groove 33. The depth of the reception depressions 30 or the diagonal groove 33 is greater than the material thickness of the holding element 25 or the central portion 26, which is substantially exclusively located in a plane at right angles to the center axis of hotplate 1. The base part of shoulder 32 shaped out of the cover plate 4 can engage on the center stud 8 or on its lower end face.

FIG. 3 shows the cover plate 14 in dot-dash line form. As shown in FIG. 3, the depth of the diagonal groove 33 can vary slightly with respect to at least one or both reception depressions 30 and appropriately groove 33 has a reduced depth. The part of the curved portion 27 connected tangentially to the central portion 26 engages in the reception depression 30. The width of the reception depressions 30 can differ as compared with the diagonal groove 33. However, in at least one area, the width of the reception depression 30 or the diagonal groove 33 is relatively closely adapted to the associated width of the holding element 25, so that the electric hotplate 1 is secured against rotation by stop limiting with respect to holding element 25 and therefore positively with respect to the cooker plate 20.

Appropriately the electric hotplates 1 of the described type have on the underside at least one turning preventing and/or positioning member 34, through which cover plate 14 is prevented from turning with respect to the hotplate body 2 and which on fitting the hotplate 1 on cooker plate 20 serves as a marker for rotation position orientation, e.g. so that a robot can detect the rotation position. As a result of the inventive reception depressions, there is in fact no need for such a positioning member 34, because at least one reception depression can fulfill its function. For example for using correspondingly equipped robots, said positioning member 34 can additionally be provided in angularly displaced manner with respect to the reception depressions 30. It is appropriately formed by a cut-out in the lower end face 16 of the outer flange edge 6 of the hotplate body 2, said cut-out being significantly narrower than the cut-out 31. On its ring edge 15, cover plate 14 has a shoulder adapted to said cut-out, which engages in much the same way as shoulder 32 in its associated cut-out and on the underside forms an engagement depression.

In the embodiment according to FIG. 4, in a view of the underside, all the holding elements 25 extend roughly parallel to the outer edges of the cooker plate 20, the holding elements 25 for adjacent electric hotplates 1 extending transversely and preferably at right angles to one another. The connection ends of at least on and in particular all the hotplates 1 combined into a connecting coupling 35 are directed essentially towards the center of cooker plate 20, so that in each case two connecting couplings 35 are directed substantially against one another and all the hotplates 1 can be connected from the center of the cooker plate 20.

Much the same applies in the construction according to FIG. 5. However, here at least one or all the holding elements 25 are under an angle of preferably approximately 45° to the outer edges of the cooker plate 20, so that adjacent holding elements 25 are also under an angle to one another.

In the construction according to FIG. 6 the holding elements are substantially the same as in the construction according to FIG. 5, but the connecting coupling of at least one and in particular all the hotplates, on the side remote from the center of the cooker plate 20, is such that the particular connecting coupling 35, is substantially directed against one of the four associated corners of the cooker plate 20.

In the construction according to FIG. 7 the holding elements are once again much as described in FIG. 4, but the connecting couplings 35 point outwards. It is also conceivable to provide at least one holding element roughly parallel and at least one holding element sloping towards the outer edges of the cooker plate and/or for at least one connecting coupling to be directed towards the center and at least one connecting coupling away from the center of the cooker plate.

Figure 8:
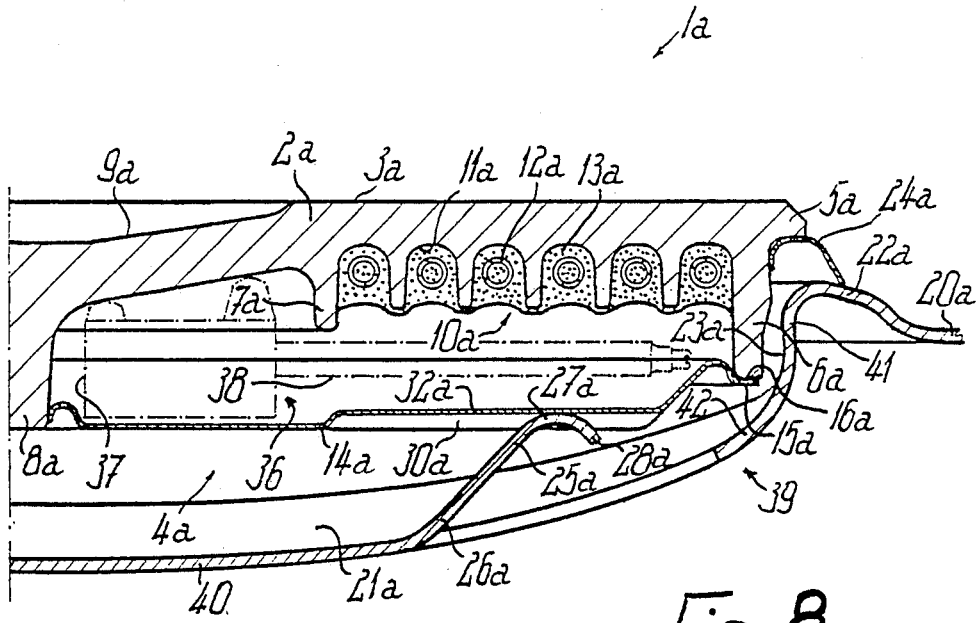
FIG. 8: a detail of another embodiment of an electric hotplate in cross-section.
Figure 9:
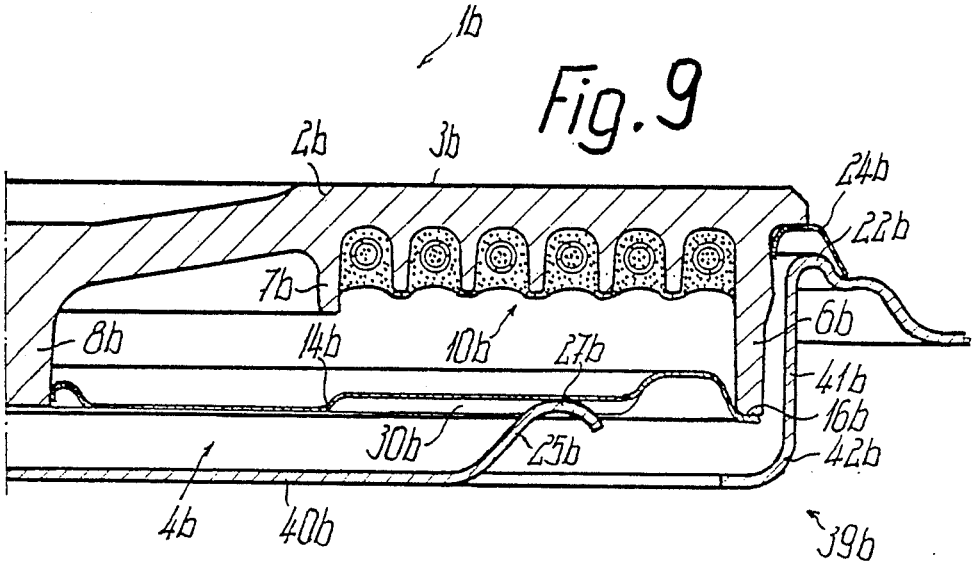
FIG. 9: another embodiment in a view corresponding to FIG. 9.

In FIGS. 8 and 9 corresponding parts are given the same reference numerals as in FIGS. 1 to 7, but followed by the letter a in FIG. 8 and b in FIG. 9.

In the embodiment according to FIG. 8 out of the cooker plate **20*a* is shaped in one piece a holding or retaining shell 39, whose bottom and circumference are substantially closed and which is connected with its approximately cylindrical shell edge 41, which is significantly lower than the outer flange edge 6*a*, directly to the inner circumference or jacket of sill 22*a*. The shell bottom 40 is curved relatively flat in two planes and in fact approximately spherical segmentally, so that its curved inside receives the underside 4*a* of electric hotplate 1*a*. The shell bottom 40 passes via a cross-sectionally, approximately pitch circularly curved transition zone 42 with a relatively large radius of curvature into the shell edge 41, said transition zone 42 essentially forming the area of maximum approximation of the shell 39 to the hotplate body 2*a* in the vicinity of the outer edge of the lower end face 16*a* of flange edge 6*a*. The inner circumference of shell edge 41 can be smaller than the outer circumference of collar 5 and adapted relatively closely to flange edge 6*a* for forming an opening edge 23*a* located only in the gap relative to the outer circumference of flange edge 6*a*. The bearing ring 24*a* engages on sill 22*a* radially slightly outside the top region. In this embodiment holding element 25*a* is appropriately constructed in one piece with the holding shell 39 and is preferably shaped out of its shell bottom 40, in such a way that in a view of the underside it projects substantially radially outwards from the center axis of hotplate body 2*a*, but projects in strip-like manner over the inside of the shell bottom 40 towards the underside 4*a* of hotplate 1*a*. With a tongue root-like transition portion 26*a*, holding element 25*a* is connected in one piece to the shell bottom 40 and in the vicinity of said transition portion 26*a* is bent out by an angle of less than 90° against the cover plate 14*a* out of the shell bottom 40, in such a way that the latter has a slit-like opening corresponding to the development of holding element 25*a*. In the vicinity of its free end, the holding element 25*a* is curved or bent in the manner of a ski in pitch circular manner towards the inside of the shell bottom 40, so that its free end leg 28*a* is directed against the shell bottom 40 and the curved outside outside engages under pretension on the bottom wall 32*a* of the reception depression 30*a* exclusively provided in the cover plate 14*a*. Radially within its ring edge 15*a*, cover plate 14*a* has for centering purposes a torus projecting in bead-like manner towards the inner circumference of flange edge 6*a*. The radially inner edge of said torus projects downwards over the lower end face of flange edge 6*a* or ring edge 15*a*, so that the otherwise planar bottom of the cover plate 14*a* is lower than said lower end face or is located roughly in the plane of the lower end face of center stud 8*a*. The radial groove-like reception depression 30*a* is shaped into the base wall and extends from the radially inner edge of the torus of cover plate 14*a* roughly only over that part of the radial extension of the bottom of the cover plate 14*a* which is located beneath the heating zone 10*a*. The depth of the reception depression 30*a* is smaller than the spacing of the bottom of cover plate 14*a* from ring edge 15*a*. The construction of the holding element and the reception depression can also be in accordance with German utility models 87 02 478 and/or 87 08 395, to which reference should be made for further details and effects. Electric hotplate 1a projects less far over the top of the holding shell 39 than to the bottom. It is very well protected within the reception opening 21 formed by the holding shell 39 and the latter essentially forms a second, thicker-walled cover plate located below the cover plate 14a**.

So that despite the reduction of the mechanical strength through the reduction of the height of the flange edge 6a, the hotplate body 2a is well protected against thermal strain deformations, a temperature switch 36 is provided, which permanently monitors the temperature of the hotplate body 2a and on exceeding a predetermined limit wholly or partly switches off the heating system and automatically connects in again on dropping below this limit. Thus, the material thickness of the hotplate body 2a, optionally also in the vicinity of depression 9a, can be made smaller than in the vicinity of the heating zone 10a or cooking surface 3a, the material thickness in said area being understood as the measure between the cooking surface 3a and the bottom of the spiral groove or grooves 11a. A ceramic insulating material, e.g. steatite switch casing 37 of temperature switch 36 with upwardly directed projections engages in the vicinity of depression 9a on the underside remote from the cooking surface 3a and which is circularly bounded by the inner flange edge 7a and the center stud 8a. Switch case 37 can be resiliently supported with its underside on the bottom of the cover plate 14a, so that between the latter and the underside of the hotplate body 2a it is secured by a bracing effect. The switch case 37 contains a switching contact (not shown), e.g. a snap switch, which is influenced by a temperature sensor 38. The latter could admittedly be located, e.g. in the form of a bimetallic sensor, within the switch case 37, but is appropriately constructed as an external temperature sensor 38, which is rigidily mechanically connected to the switch case 37 and is therefore exclusively carried by the latter. The rod-like temperature sensor 38 having an outer tube and an inner rod with different thermal expansion coefficients projects freely from the side of the switch case 37 remote from the center stud 8a or with respect to cover plate 14a and the underside of heating zone 10a in contact-free manner. It extends approximately over the entire radial extension of the heating zone 10a and is located very closely below the latter or below the inner flange edge 7a roughly parallel to cooking surface 3a. The undersides of switch casing 37 or temperature sensor 38 can extend up to the level of the lower end face 16a of flange edge 6a or even lower. The temperature switch 36 is only indicated by dot-dash lines in FIG. 8.

In the embodiment according to FIG. 9 the holding shell 39b is substantially cylindrical shell-shaped. It has a substantially through, planar shell bottom 40b, a through, approximately cylindrical shell edge 41b over its entire height, which is the same or greater than the outer flange edge 6b and between the two a transition zone 42b, which has a relatively small radius of curvature. The shell bottom 40b can therefore have a substantially constant spacing throughout with respect to the underside 4b of the electric hotplate 1b, said spacing being greater than the circumferential spacing of shell edge 41b with respect to flange body 6b. The lower end face 16b of the outer flange edge 6b is in this case roughly level with the lower end face of the center stud 8b, the cover plate 14b projecting downwards over this plane substantially only with its material or sheet metal thickness, so that a very favorable stacking surface for the stacked transportation of identical electric hotplates 1b is provided. Whereas in the case of the embodiment according to FIG. 8, the sill 22a drops flat radially outwards from the top, the sill 22b according to FIG. 9 is stepped radially outwards from the top, the bearing ring 24b resting on the lower ring step immediately adjacent to the top.

We claim:

1. An electric hotplate, comprising:

a hotplate body providing a cooking surface and an underside remote from said cooking surface, said hotplate body providing an annular radially outer region enclosing a heated region which encloses a center region;

at least one engagement member for a holding element for securing the hotplate with respect to a cooker plate, wherein means are provided for traversing said holding element at least over a part of said underside along said underside and in a vicinity of said underside at a level substantially above a lowest plane defined by said underside.

2. The hotplate according to claim 1, wherein on the underside, the hotplate body has at least one projection projecting over a heating zone, said hotplate body having a substantially annular outer flange rim, a center stud and an inner flange rim, said outer flange rim having a smaller annular height extension than the center stud, a substantially annular lower end face of said outer flange rim being provided substantially in a middle of a height extension between lower end faces of the center stud and said inner flange rim.

3. The hotplate according to claim 1, wherein on the underside, the hotplate body has at least one projection projecting over a heating zone, said hotplate body having a substantially annular outer flange rim, a center stud and an inner flange rim, said outer flange rim having a smaller annular height extension than the center stud.

4. An electric hotplate comprising:

a hotplate body providing a cooking surface and an underside remote from said cooking surface, said underside defining different height extensions of said hotplate body, the hotplate body providing a radially outer region;

at least one engagement member for a holding element for securing the hotplate with respect to a cooker plate, wherein said hotplate body has a lower height extension in at least a part of said radially outer region than in a region radially inside of said radially outer region, said hotplate body being provided on said underside with at least one reception depression for a substantially surface-flush reception of at least part of the holding element.

5. The hotplate according to claim 4, wherein at least one reception depression of said hotplate body is adapted to said holding element and is formed by a groove-like cut-out, thereby providing a rotation preventing means for said hotplate.

6. The hotplate according to claim 4, wherein a width extension of at least one said at least one reception depression of said hotplate body is adapted to a width extension of the holding element, the holding element having a strip-like configuration.

7. The hotplate according to claim 4, wherein a lower end of a center stud and a lower end face of an outer flange rim of said hotplate body are set back with respect to said underside of the hotplate body at least by between a thickness extension of said holding element and more than said thickness extension.

8. The hotplate according to claim 4, wherein at least two facing and substantially equally large reception depressions are provided on an outer flange rim of said hotplate body.

9. The hotplate according to claim 4, wherein in the vicinity of the underside of said hotplate body is provided a cover plate constructed for receiving said holding element in a substantially flush manner with respect to the underside of said hotplate and said hotplate body.

10. The hotplate according to claim 4, wherein at least one furthest downwardly projecting projection of said hotplate body is constructed for a substantially surface-flush reception of the holding element.

11. The hotplate according to claim 4, wherein at least one said at least one reception depression for said holding element is located in spaced manner completely within an inner circumference of an outer flange rim of said hotplate body, said reception depression connecting to an edge of a ring groove formed by a cover plate for said hotplate body.

12. The hotplate according to claim 4, wherein on the underside of said hotplate is provided a connecting piece held on a cover plate by an insulator, said connecting piece being circumferentially displaced with respect to at least one said at least one reception depression for said holding element by an angle of substantially between one of 45° and an integral multiple of 45°.

13. An electric hotplate comprising:

a hotplate body providing a cooking surface and an underside remote from said cooking surface, said underside determining different height extensions of said hotplate body, the hotplate body providing a radially outer region;

at least one engagement member for a holding element for securing the hotplate with respect to a cooker plate, wherein said hotplate body has a lower height extension in at least a part of said radially outer region than in a region radially inside of said radially outer region, said hotplate being constructed for receiving a holding element constructed between at least partly and substantially completely in one piece with said cooker plate, at least one end of said holding element being connected in one piece to a shell bottom of a shell-like reception opening for the hotplate, said shell bottom being shaped out of said cooker plate.

14. An electric hotplate comprising:

a hotplate body providing a cooking surface and an underside remote from said cooking surface, said underside determining different height extensions of said hotplate body, the hotplate body providing a radially outer region;

at least one engagement member for a holding element for securing the hotplate with respect to a cooker plate, wherein said hotplate body has a lower height extension in at least a part of said radially outer region than in a region radially inside of said radially outer region, said hotplate being constructed for reception in a substantially spherical segmentally bounded reception opening having a greatest approximation to said hotplate body substantially in a vicinity of a lower end face of an outer flange rim of said hotplate body.

15. The hotplate according to claims 1, 4, 13 or 14, wherein a cover plate for said hotplate body engages with an outer ring disk-like annular edge on an annular end face of an outer flange rim of said hotplate body, said annular edge of said annular end face being located higher than a lower end face of a center stud of said cover plate.

16. The hotplate according to claims 1, 4, 13 or 14, wherein a cover plate for said hotplate body has a radial groove-like reception depression for said holding element.

17. The hotplate according to claims 1, 4, 13 or 14, wherein a cover plate for said hotplate body has on an edge at least one projection for engaging in at least one reception depression of an outer flange rim of said hotplate body, said projection being constructed in a manner of a lining of a cut-out in said outer flange rim, said projection forming an inner face of a reception depression for said holding element.

18. The hotplate according to claim 17, wherein said projection of said cover plate forms an end of a longitudinal reception depression, said cover plate being secured with a base portion of said reception depression against a center stud of said hotplate body.

19. The hotplate according to claims 1, 4, 13 or 14, wherein said hotplate body is protected against thermal overloads by a temperature switch, a rod-like temperature sensor being located in substantially contact-free manner between said hotplate body and a cover plate for said hotplate body, a switch casing being located in the vicinity of an unheated central zone of said hotplate body.

20. The hotplate according to claims 4, 13 or 14, wherein said hotplate is constructed for placing on a cooker plate having at least one reception opening for said hotplate in the vicinity of a raised sill passing substantially directly into a wall of said at least one reception opening, at least most of an opening edge of at least one of said at least one reception opening being located higher than a transition of said holding element into said cooker plate, a bearing ring of said hotplate projecting over an annular clearance between an outer flange rim of said hotplate body and a circumferential wall of said reception opening, said bearing ring engaging said cooker plate radially outside of a top area of said sill.

21. An electric hotplate, comprising:

a hotplate body providing a cooking surface and an underside remote from said cooking surface;

at least one engagement member for at least one holding element for securing the hotplate with respect to a cooker plate, wherein said hotplate is constructed for receiving at least one said at least one holding element constructed between at least partly and substantially completely in one piece with said cooker plate, at least one end of said at least one holding element being connected in one piece to a shell bottom of a shell-like reception opening for the hotplate, said shell bottom being shaped out of said cooker plate.

* * * * *